US005550320A

United States Patent [19]

Hirano

[11] Patent Number: 5,550,320

[45] Date of Patent: Aug. 27, 1996

[54] ELECTRONIC SOUND GENERATING DEVICE FOR GENERATING MUSICAL SOUND BY ADDING VOLUME FLUCTUATION TO PREDETERMINED HARMONICS

[75] Inventor: Sayoko Hirano, Hamamatsu, Japan

[73] Assignee: Kabushiki Kaisha Kawai Gakki Seisakusho, Hamamatsu, Japan

[21] Appl. No.: 250,032

[22] Filed: May 26, 1994

[30] Foreign Application Priority Data

May 27, 1993 [JP] Japan ..... 5-126110

[51] Int. Cl.[6] ..... G10H 1/02; G10H 7/00

[52] U.S. Cl. ..... 84/623; 84/629; 84/631

[58] Field of Search ..... 84/622, 623, 629, 84/631, 664

[56] References Cited

U.S. PATENT DOCUMENTS

Re. 34,481 12/1993 Ishibashi ..... 84/623 X 4,159,663 7/1979 Aoki et al. .

4,215,614 8/1980 Chibana .

4,387,622 6/1983 Deutsch .

5,040,448 8/1991 Matsubara et al. ..... 84/622

*Primary Examiner*—William M. Shoop, Jr.

*Assistant Examiner*—Jeffrey W. Donels

*Attorney, Agent, or Firm*—Davis, Bujold & Streck, P.A.

[57] ABSTRACT

An electronic sound generating device is proposed which can generate sound that is complex, profound and high in fidelity to acoustic sound. Sound of the acoustic instruments consists of a plurality of harmonics. Some of the harmonics have swings on their envelope curves, thereby causing beats of the sound. Inspired by this feature, the present invention causes swing on predetermined harmonics in synthesizing a plurality of harmonics for generating sound. A construction for swinging the envelope curves is also proposed.

4 Claims, 7 Drawing Sheets

ELECTRONIC SOUND GENERATING DEVICE FOR GENERATING MUSICAL SOUND BY ADDING VOLUME FLUCTUATION TO PREDETERMINED HARMONICS

FIELD OF THE INVENTION

This invention relates to an electronic sound generating device which generates musical sound by synthesizing a plurality of harmonics.

BACKGROUND OF THE INVENTION

In order to electronically generate musical sound with high fidelity, the recent trend in electronic piano is such a method in which samples of acoustically generated sound are stored in the form of PCM waveform data in memory of the electronic piano. In such electronic piano, sound is created by reading out the PCM waveform data. However, this method has a drawback: a massive amount of storage area is required for storing the PCM waveform data for each and every key of the piano and with respect to each key stroke intensity.

It is widely known that sound generated by the acoustic piano is composed of a plurality of harmonics. It is also known that any sound waveform can be created by synthesizing a plurality of sine waves. There leads to the method of generating sound by synthesizing sine waves of a plurality of harmonics.

By adopting this method, the data storage amount that has to be allocated for generating sound of all the piano keys and respective key stroke intensity is minimized and storage capacity of the memory is saved.

Meanwhile, when frequency analysis is conducted on the instantaneous frequency of the tone of the acoustic piano, a frequency spectrum corresponding to a plurality of harmonics is obtained, as shown in FIGS. 2A and 2B. The inventor of the present invention examined such frequency spectrum in every predetermined time period. When the harmonics included in the frequency spectrum were assorted on a time chart, it turned out that some of these harmonics have envelope curves of relatively smooth declination as shown in FIG. 3A, while other harmonics have swing (volume fluctuation) on their declining envelope curves as shown in FIG. 3B. Taking this into consideration, the inventor concluded that some harmonics among those to be synthesized need swing on their envelope curves in order to perfectly imitate sound of the acoustic instruments.

The prior art device or system generates musical sound by synthesizing sine waves of a plurality of harmonics. The prior art device or system, however, disregards the above described swing of envelope curve of harmonics and results in generating poor sounds. Although it has been devised to give swing to the whole sound created from synthesized sine waves and generates tremolo or vibrato sound, sound generated without tremolo or vibrato is still a plain sound lacking in richness. It was impossible to imitate complex and profound genuine sound of piano, violin and other acoustic instruments.

SUMMARY OF THE INVENTION

Wherefore, in the method of generating musical sound by synthesizing a plurality of harmonics, the object of the present invention is to generate sound that is as complex and profound as the sound generated by the acoustic instruments.

Another object of the invention is to generate such sound without using a complicated mechanism for conducting time-taking calculation.

In order to attain the object of the invention, the electronic sound generating device according to the present invention adopts the generation of musical sound by synthesizing a plurality of harmonics. Further, the electronic sound generating device includes swing adder means for swinging envelope curves of predetermined harmonics among those harmonics which are synthesized for generating musical sound.

In order to attain the object, the swing adder means of the electronic sound generating device swings the envelope curves of the predetermined harmonics by adding simultaneously two or more frequencies having a predetermined difference and thereby causing beats corresponding to the frequency difference.

In the electronic sound generating device, the swing adder means swings the envelope curves of predetermined harmonics. The swings given to the predetermined harmonics have varied cycle and fluctuation. These harmonics are mixed and synthesized with the other harmonics which were not given such swing to their envelope curves. As a result, the musical sound created according to this invention has swing of respective harmonics complicatedly entwined one another, and not the simple kind of swing of a whole sound. Thus, sound of acoustic instruments and a more complex sound can be created.

For attaining the respective swing of the envelope curves of the predetermined harmonics, the instant electronic sound generating device gives to the predetermined harmonics simultaneously two or more frequencies having a predetermined difference, thereby causing beats corresponding to the frequency difference.

The one who skilled in the art might think of the following alternative for attaining the swing of envelope curve. Specifically, the shift of the waveform level that will be caused by swing of envelope curve is obtained by calculation and the result is regarded as the envelope curves to be obtained and applied on the respective harmonics. However, this method takes time and requires a CPU or other means for performing the necessary fast calculation.

According to the present invention, on the other hand, the swing of the envelope curves are caused automatically from the interference between the different frequencies. Therefore, the present electronic sound generating device does not need the aforementioned fast calculation means.

Other objects, advantages and novel features of the invention will become apparent from the following detailed description of the invention when considered in conjunction with the accompanying drawings.

DETAILED DESCRIPTION OF THE PREFERRED EMBODIMENT

Figure 1:
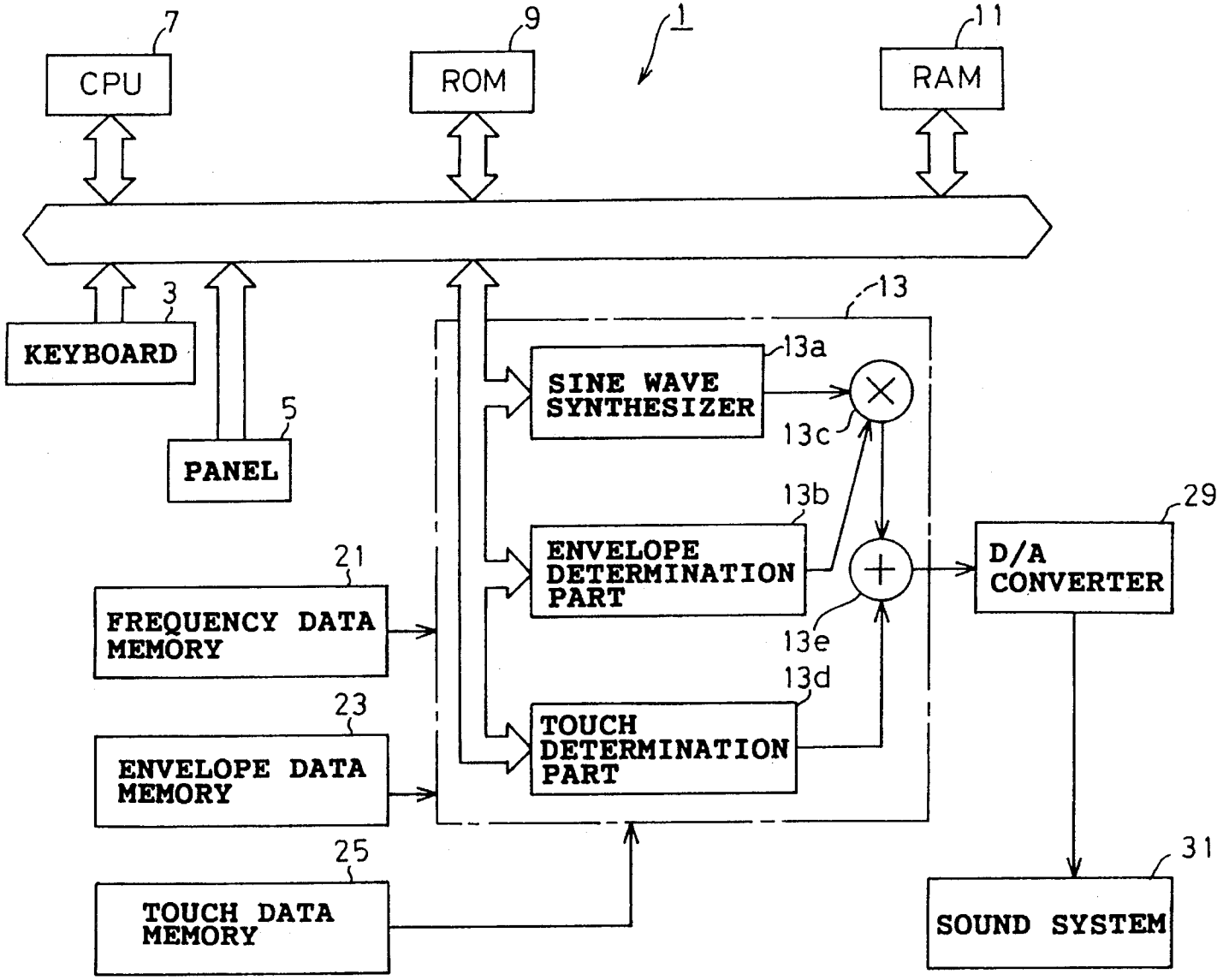
FIG. 1 is a block diagram schematically showing the structure of an electronic piano of the embodiment.

As shown in FIG. 1, an electronic piano 1 includes a keyboard 3, panel 5, CPU 7, ROM 9, RAM 11 and sound signal generating part 13 which are interconnected via a system bus.

The keyboard 3 is provided with eighty eight keys corresponding to the acoustic piano keys, and touch sensors for detecting a depression and release of keys and intensity in striking the keys.

The panel 5 is provided with a variety of switches such as power switch and mode selection switch.

The CPU 7 receives the signal input from the keyboard 3 and the panel 5 and performs corresponding control process.

The ROM 9 stores program memory for use when the CPU is to effect the control process. The ROM 9 also stores timbre data memory.

The RAM 11 is used for a variety of process such as assigner process performed by the CPU 7.

The sound signal generation part 13 generates sound signals in response to the instruction from the CPU 7, and is connected to a frequency data memory 21, envelope data memory 23 and touch data memory 25.

In the frequency data memory 21, there is stored the frequency analysis result of sound waveforms which are obtained when a key is struck softly, moderately hard and hard. Specifically, stored in the frequency data memory 21 are frequencies x1, x2, - - - , xn, - - - [Hz] of the harmonics and their level ratio l1, l2, - - - , ln, - - - . As for a predetermined n harmonics, the corresponding level ratio to be stored is the level ratio ln1 which is smaller than the actual level ratio ln of the frequency analysis result. Further, a frequency (xn+an) [Hz] and its level ratio ln2 are stored. The (xn+an) [Hz] is the addition of a minute frequency an [Hz] to the n harmonics frequency of xn [Hz]. The values of ln1 and ln2 are devised such that the addition of ln1 and ln2 is substantially equal to ln.

The minute frequency an [Hz] is obtained in the following manner.

Figure 2A:
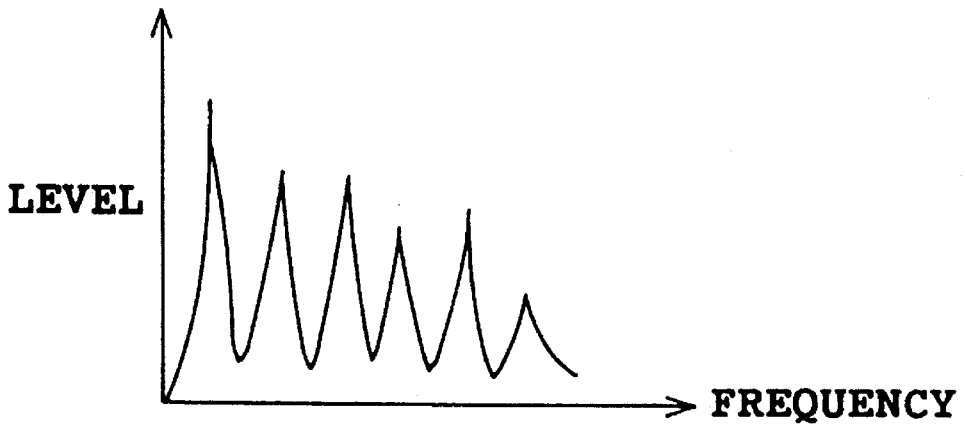
FIGS. 2A and 2B are time charts of the analyzed frequency and its spectrum of the acoustic instrument.
Figure 2B:
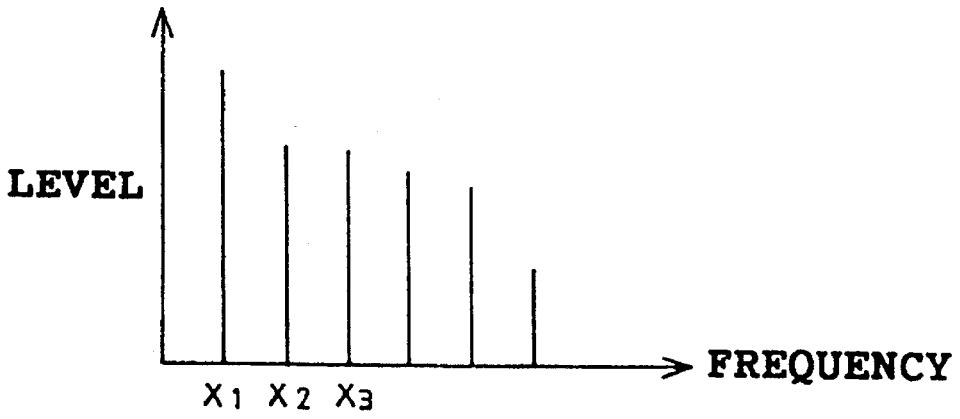
Figure 3A:
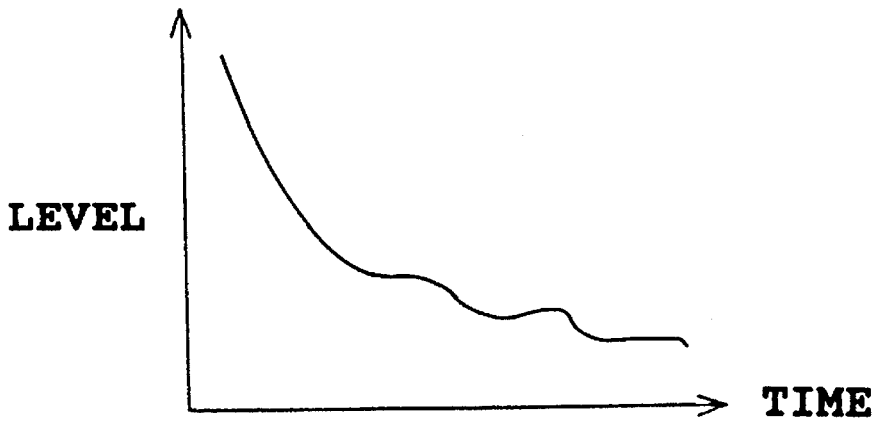
FIGS. 3A and 3B are time charts of the envelope curve obtained for each harmonics from the analysis of the frequency spectrum.
Figure 3B:
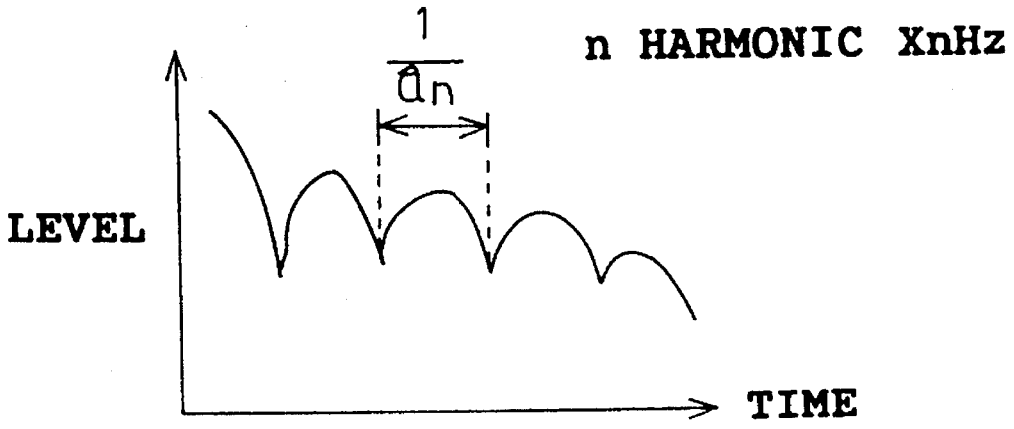

First, a piano sound is sampled, after its reaching an attack level which is a peak of envelope curve, in every predetermined time period. Frequency analysis of the sample is derived as shown in FIGS. 2A and 2B, which are the Analyzed Instantaneous Frequency curve and the Instantaneous Frequency Spectrum curve, respectively. According to the frequency analysis, the shift of the waveform level of each harmonics composing the piano sound is plotted against a time chart as shown in FIGS. 3A and 3B, which are the Harmonic Envelope Curve Without Swing and the Harmonic Envelope Curve With Swing, respectively. As a result, envelope curve of the individual harmonics, which will be referred to as "harmonic envelope curve" hereinafter, is obtained.

Next, among the obtained harmonic envelope curves, those harmonic envelops curves of predetermined n harmonics which have swing as shown in FIG. 3B are examined. Specifically, one cycle of the swing (1/an) [sec] is determined. Consequently, a reciprocal of the one cycle of the swing (1/an) [sec] is determined to be the minute frequency an [Hz].

The level ratio ln1 and ln2 for the frequency xn [Hz] and the frequency (xn+an) [Hz], respectively, are determined according to the fluctuation largeness of the swing obtained from FIG. 3B.

For example, a waveform obtained by synthesizing sine waves having a unit level of the frequency xn [Hz] and sine wave having a unit level of the frequency (xn+an) [Hz] is calculated. Then, the level of the synthesized waveform is made equal to the level of the frequency analysis result of n harmonics. Consequently, the levels of both the sine waves are calculated such that the scale of the beats becomes equal to the fluctuation largeness of the swing. Alternatively, the level of both sine waves may be coordinately altered so as to become, for instance, 5:5, 7:3 and 3:7 and the beats generated from the synthesized waves may be calculated. According to the calculation result, the level ratio would be obtained by way of interpolation or other appropriate method.

Figures 4A, 4B, 4C:
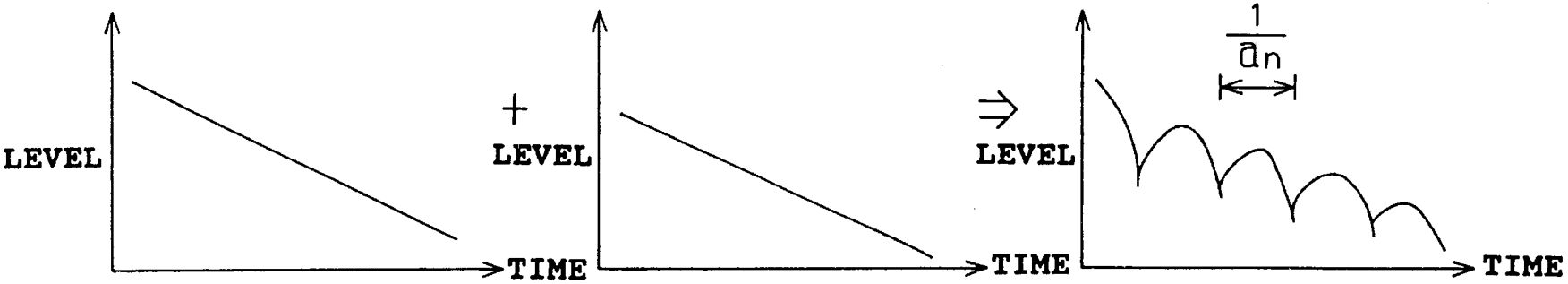
FIGS. 4A, 4B and 4C are time charts explaining how the swing of harmonic envelope curve is generated.

When a predetermined envelope curve without swing is applied on both of the sine waves of the frequency xn [Hz] and the frequency (xn+an) [Hz] having a small difference of an [Hz] and they are synthesized, swing similar to that shown in FIG. 3B are caused, as shown in FIG. 4. FIGS. 4A–4C are the Envelope Curve of XnHz, the Envelope Curve of (Xn+an)Hz, and the Envelope Curve With Swing, respectively. Alternatively, the same result can be attained by first synthesizing the both sine waves and next applying a predetermined envelope curve on the synthesized waves.

The envelope data memory 23 stores envelope curves of sound waveform which are obtained by depressing keys of the grand piano. It is not required to store the envelope curves for all the harmonics and it is sufficient if an envelop curve is stored for a single key. In the present embodiment, one envelope curve is stored for one key. However, it may be also possible to provide a plurality of envelope curves for a single key, for example, such that separate envelope curves is provided for lower, middle and higher tone harmonics groups. It may be further possible to provide one envelope curve for a group of a plurality of keys.

The touch data memory 25 stores touch or impact element which is included in the sound waveform of the acoustic piano sounds. Since all of the piano keys have almost the same key stroke impact, a single touch data would be sufficient for all the keys. However, it is preferable to provide the touch data with respect to each tonal unit. This is because hammers of the piano have slightly different weight according to their pitch and the difference of weight results in a subtle difference in touch. In the present embodiment, the touch data is stored with respect to each tonal unit. The touch data includes the partial envelope curve before its reaching the attack level, indicating the touch or impact element.

The sound signal generating part 13 includes a sine wave synthesizer 13*a*, envelope determination part 13*b*, multiplier 13*c*, touch determination part 13*d* and adder 13*e*. The sine wave synthesizer 13*a* synthesizes sine waves according to the memory in the frequency data memory 21. The envelope determination part 13*b* determines envelope curve according to the memory in the envelope data memory 23. The multiplier 13*c* multiplies the sine waves synthesized at the sine wave synthesizer 13*a* by the envelope curve determined at the envelop determination part 13*b*. The touch determination part 13*d* determines touch element of the sound according to the memory in the touch data memory 25. The adder 13*e* adds to the multiplication result obtained by the multiplier 13*c* the waveform of the touch element determined by the touch determination part 13*d*. The number of these components provided are equal to that of polyphonics of the electronic piano. Thus, it is enabled to simultaneously generate sound signals for a plurality of keys.

The sound signals generated at the sound signal generating part 13 is sent to the D/A converter 29 and the sound system 31, thereby emitting sound.

The electronic piano 1 of this embodiment is capable of creating not only sound of the piano, but also sound of other instruments such as the harpsichord and pipe organ. The frequency data memory 21, envelop data memory 23 and touch data memory 25 therefore store harmonic frequencies for such other instruments which are obtained from the frequency analysis, and other data such as the data of differed frequencies calculated according to the present invention.

Figure 5:
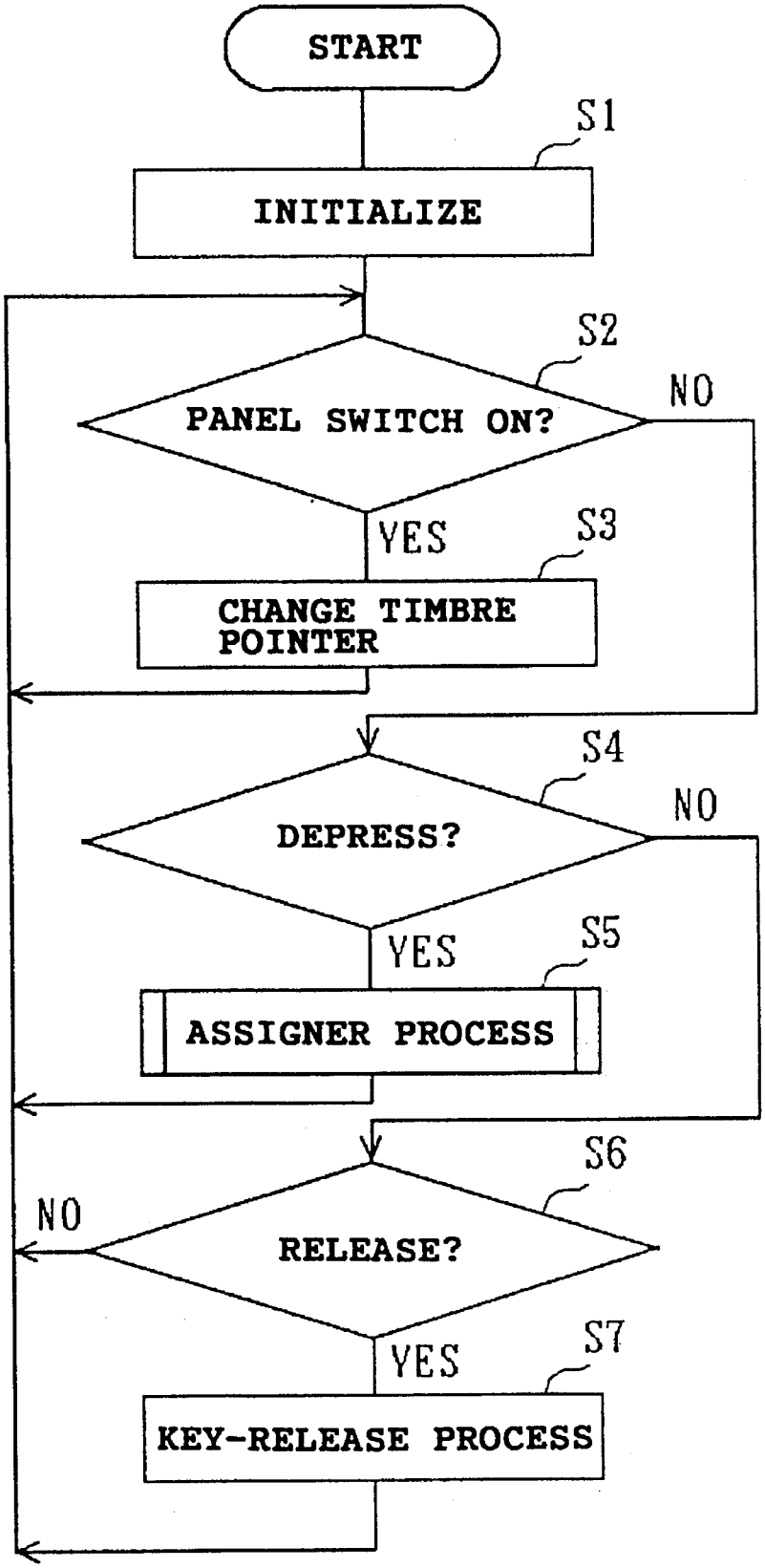
FIG. 5 is a flowchart of the main routine of the embodiment.

The electronic piano 1 operates according to the main routine shown in FIG. 5.

First, when a power switch provided on the panel 5 is turned on, initialization process is performed, at step S1. The initialization process includes initialization of the register within the CPU 7 and the RAM 11, and transfer of a given data within the ROM 9 to the RAM 11. The initialization process also includes initialization of timbre pointer and determination of initial timbre, such as piano timbre, harpsichord timbre, pipe organ timbre. Conventionally, electronic pianos have the piano timbre as initial timbre.

Next, it is determined, at step S2, whether a switch for changing timbre on the panel 5 is switched on. If "YES" is determined at this step, the timbre pointer is changed according to the operation on the panel switch, at step S3. Thus, one of the timbres of piano, harpsichord, pipe organ and other instruments stored in the electronic piano 1 is chosen for the play.

Following the initialization and determination of timbre, it is determined, at step S4, whether a key on the keyboard 3 is depressed. When a key is depressed, the assigner process is performed, at step S5. Specifically, data concerning the determined timbre, key touch and key number detected by the touch sensor and other various data are assigned to vacant sine wave synthesizer 13*a* and other components of the sound signal generating part 13 among a plurality of them. Sound signal is thus generated according to which key was struck and how.

On the other hand, when "NO" is determined at step S4, it is determined, at step S6, whether a key is released. According to the result, the key-release process is performed, at step S7. Specifically, according the key number of the released key, a given release data is sent to the envelope determination part 13*b* now working for the key, thereby having the envelope curve decline to zero value and cutting off the sound.

Figure 6:
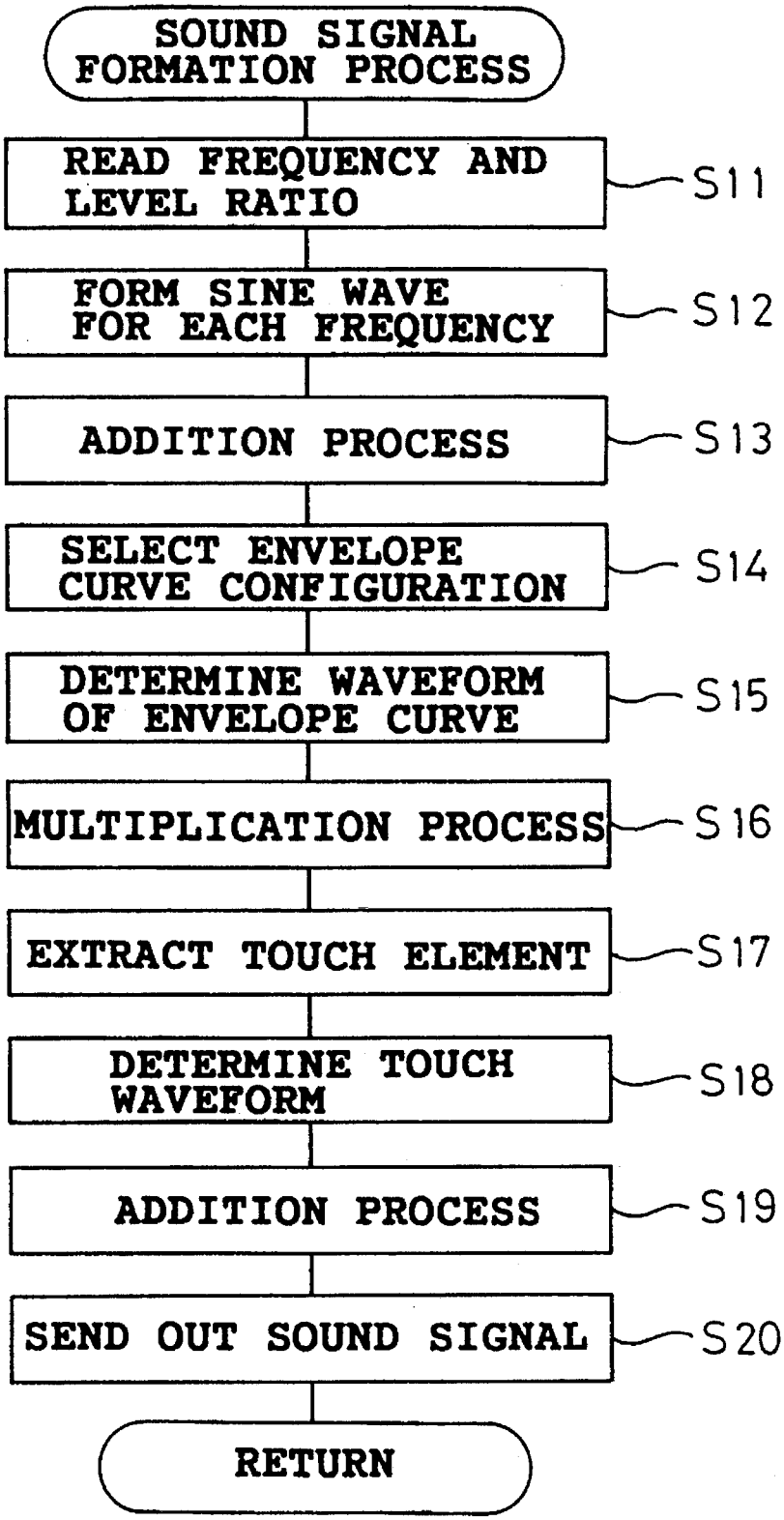
FIG. 6 is a schematic flowchart of the sound signal formation process in the embodiment.

The sine wave synthesizer 13*a* operates, as shown in the flowchart of FIG. 6, in the following manner.

Receiving the data concerning the timbre, key touch, key number and other various information, the sine wave synthesizer 13*a* reads out the corresponding frequencies x1, x2, - - - xn, (xn+an) - - - and level ratio l1, l2, - - - ln1, ln2, - - - from the frequency data memory 21, at step S11. The sine wave synthesizer 13*a* then generates sine waves for each of the frequencies and level ratio, at step S12. Consequently, the sine wave synthesizer 13*a* adds all the sine waves and thereby generates synthesized waveform, at step S13. The synthesized waveform thus obtained contains subtle beats resulted from the interference between the frequency of xn [Hz] and the frequency of (xn+an) [Hz].

Next, the envelope determination part 13*b* receives the data concerning the timbre, key touch, key number and other various information, and refers to the data stored in envelope data memory 23 according mostly to the timbre and key number information. Thereby, the envelope determination part 13*b* selects, at step S14, an envelope curve having a predetermined configuration. The envelope determination part 13*b* further obtains an attack level according to the touch data, and determines the waveform of the envelope curve, at step S15. Consequently, the determined waveform of the envelope curve and the above described sine waves of a plurality of frequencies obtained at the step S13 and step S15 are sent to the multiplier 13*c*, and multiplied by one another, at step S16.

The touch determination part 13*d* retrieves a predetermined touch element from the touch data memory 25 according to the timbre and key number, at step S17. The touch determination part 13*d* then adds to the retrieved touch element an attach level determined according to the key touch, thereby obtaining a touch waveform, at step S18. Further, the touch determination part 13*d* sends the multiplication result obtained at the step S16 and the touch waveform obtained at the step S18 to the adder 13*e* where they are added, at step S19. Sound signal is thus generated and sent out to the D/A converter 29, at step S20.

By virtue of the above described structure, it is enabled to generate sound having a given harmonics with respective swing present on their envelope curves, similarly to the sound created by the acoustic instruments. The sound waveform of the generated sound has various harmonic envelope curves entwined; some harmonic envelope curves have swing thereon, some are without swing, and some are with different manners of swing. Thus, it is enabled to electronically generate the sound of the acoustic instruments.

Further, the electronic sound generating device need not store massive amount of PCM waveform data and thereby saves the storage capacity.

The swing of the harmonic envelope curves are obtained naturally through the beat caused by the interference between sine waves having a slightly different frequencies. Therefore, the device does not require a complex and time-taking calculation. Accordingly, the capacity of the CPU can be efficiently used.

This invention has been described above with reference to the preferred embodiment as shown in the drawings. Modifications and alterations may become apparent to one who skilled in the art upon reading and understanding the specification. Despite the use of the embodiment for illustration purposes, it is intended to include all such modifications and alterations within the scope and spirit of the appended claims.

Figure 7:
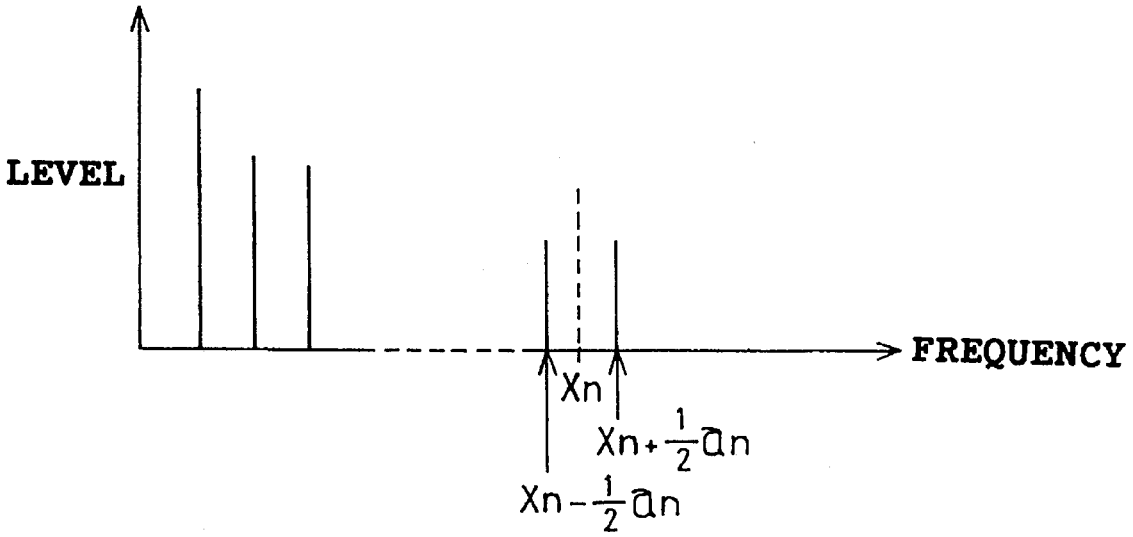
FIG. 7 is a time chart referred to in the modification.

In this spirit, it should also be noted that in the embodiment, sine waves of the frequency xn [Hz] and slightly larger frequency (xn+an) [Hz] are synthesized in order to cause the beats having the cycle of (1/an) [sec] for the envelope curve of n harmonic. However, sine waves of the frequency xn [Hz] and slightly smaller frequency (xn–an) [Hz] may be used. Alternatively, the similar effect would be attained by using the sine waves of the frequencies {xn+(an/2)} [Hz] and {xn–(an/2)} [Hz], as shown in FIG. 7.

It is not limited to sine waves that are to be synthesized. Other waveforms may be utilized for obtaining synthesized waveforms to cause swing of envelope curves.

In the embodiment, sine waves are first synthesized and the synthesized waveform is multiplied by an envelope curve. However, each of the sine waves may be first multiplied by an envelope curve and then added. In this case, multiplication must be performed a number of times in the process since the sound signal generating part 13 must first generate a sine wave for respective frequency, multiply the each sine wave by an envelope curve of respective frequency and then add up the multiplication results. Nevertheless, by taking this course of procedure, envelope curves can be provided with respect to key stroke intensity on the same piano key. This is because the variable key stroke intensity can be reflected upon the generated musical sound by varying the respective level of low, middle and high tone harmonics. Resultantly, the waveforms of the generated sound becomes as variable as those of the sound generated by the acoustic instruments.

Moreover, the difference of the sine wave's frequency to cause interference against the sine wave of xn [Hz] may be gradually shifted from an, bn, cn, dn, - - - [Hz] (bn, cn, dn, - - - ≠an). Similarly, the level ratio ln1, ln2 may be gradually shifted. By shifting the frequency difference and the level ratio, more complicated swing of the envelope curves can be attained.

Further, the difference of the sine wave's frequency to cause interference against the sine wave of the frequency xn [Hz] may not be an absolute value such as an [Hz] in the embodiment, and a proportional ratio, such as 1.01, against the xn [Hz] may be predetermined for providing the different frequency, 1.01 xn [Hz] in the exemplary case, of sine wave.

Furthermore, the frequency x1, x2, - - - xn [Hz] as absolute value of each harmonic may not be fixedly predetermined. Instead, the frequency x1 [Hz] as pitch and relative ratio 1, 2, 3, 4, 4.01, 5, - - - as coefficient of the frequency of the composing harmonics may be stored. In this case, when sine wave of 4 x1 [Hz] and sine wave of 4.01 x1 [Hz], for instance, causes an interference and generates beats, the swing of the envelope curve caused by the beats is configured as if it is that of the sine wave of 4 x1 [Hz].

Still furthermore, the device according to the present invention may not be oriented only for imitating the sound of the acoustic instruments, and may by applied as electronic sound source of synthesizer and other electronic sound generating device for providing a variety of timbres.

Wherefore, having described the present invention, what is claimed is:

1. An electronic sound generating device for generating musical sound by synthesizing a plurality of harmonics, said electronic sound generating device comprising:

storage means for storing frequencies and levels of said plurality of harmonics included in a musical sound, and storing frequencies and levels of first and second signals which have a predetermined frequency difference to generate said predetermined harmonics having a volume fluctuation, said volume fluctuation being a cyclical change of sound level;

a keyboard for designating a tone to be generated;

waveform forming means for forming a synthesized waveform responsive to an operation on said keyboard, by retrieving data from said storage means for generating sound corresponding to an operated key, forming sine waves for each harmonic according to frequencies and levels of harmonics included in said retrieved data, and by synthesizing said sine waves, said synthesized waveform including waveform of harmonic having desired volume fluctuation;

sound signal generating means for generating a sound signal by multiplying said synthesized waveform by an envelope curve specific to a timbre of sound generated by a specific musical instrument; and outputting means for outputting sound according to said sound signal generated by said sound signal generating means.

2. An electronic sound generating device according to claim 1, wherein said frequencies and levels of said first and second signals stored in said storage means are determined according to a cycle and fluctuation change of an envelope curve for each respective harmonic, said envelope curve for each respective harmonic is obtained by taking samples of a sound signal generated by an acoustic instrument and performing frequency analysis on said sound signal.

3. An electronic sound generating device for generating musical sound by synthesizing a plurality of harmonics, said electronic sound generating device comprising:

storage means for storing frequencies and levels of said plurality of harmonics included in a musical sound, and storing frequencies and levels of first and second signals which have a predetermined frequency difference to generate said predetermined harmonics having a volume fluctuation, said volume fluctuation being a cyclical change of sound level;

a keyboard for designating a tone to be generated;

sine wave forming means for forming sine wave for each harmonic by retrieving data from said storage means for generating sound, corresponding to an operated key, according to frequencies and levels of harmonics included in said retrieved data;

multiplication means for performing multiplication between the waveform of said sine wave formed by said sine wave forming means and an envelope curve predetermined according to a pitch of harmonic;

adder means for adding to each harmonic a result obtained by said multiplication means;

sound signal generating means for generating a sound signal according to a result obtained by said adder means, said sound signal including a signal of harmonic having desired volume fluctuation; and outputting means for outputting sound according to said sound signal generated by said sound signal generating means.

4. An electronic sound generating device according to claim 3, wherein said frequencies and levels of said first and second signals stored in said storage means are determined according to a cycle and fluctuation change of an envelope curve for each respective harmonic, said envelope curve for each respective harmonic is obtained by taking samples of a sound signal generated by an acoustic instrument and performing frequency analysis on said sound signal.

* * * * *